US011223906B2

(12) United States Patent
Zhang

(10) Patent No.: US 11,223,906 B2
(45) Date of Patent: Jan. 11, 2022

(54) ACOUSTIC RECEIVER HOUSING WITH INTEGRATED ELECTRICAL COMPONENTS

(71) Applicant: Knowles Electronics, LLC, Itasca, IL (US)

(72) Inventor: Yahui Zhang, Schaumburg, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 16/578,038

(22) Filed: Sep. 20, 2019

(65) Prior Publication Data

US 2021/0092527 A1 Mar. 25, 2021

(51) Int. Cl.

| | |
|---|---|
| ***H04R 13/00*** | (2006.01) |
| ***H04R 9/06*** | (2006.01) |
| ***H04R 9/04*** | (2006.01) |
| ***H04R 7/16*** | (2006.01) |
| ***H04R 9/02*** | (2006.01) |

(52) U.S. Cl.

CPC ..... *H04R 9/06* (2013.01); *H04R 7/16* (2013.01); *H04R 9/025* (2013.01); *H04R 9/045* (2013.01)

(58) Field of Classification Search

CPC ..... H04R 1/06; H04R 11/02; H04R 25/609; H04R 25/604

See application file for complete search history.

(56) References Cited

U.S. PATENT DOCUMENTS

| | | | | |
|---|---|---|---|---|
| 9,357,283 | B2 * | 5/2016 | Darlington | H04R 1/1016 |
| 9,949,051 | B2 * | 4/2018 | Higgins | H04R 19/04 |
| 10,524,068 | B2 * | 12/2019 | Karamuk | H04R 25/604 |
| 10,542,358 | B2 * | 1/2020 | Lindberg | H04R 1/1075 |
| 10,699,833 | B2 * | 6/2020 | Groffen | H04R 11/02 |
| 10,721,566 | B2 * | 7/2020 | Tjepkema | H04R 31/003 |
| 2002/0146141 | A1 * | 10/2002 | Geschiere | H04R 25/604 381/368 |
| 2005/0123166 | A1 * | 6/2005 | Chen | H04R 11/02 381/412 |
| 2016/0234586 | A1 * | 8/2016 | Sugata | H04R 11/02 |
| 2020/0204934 | A1 * | 6/2020 | Voss | H04R 17/00 |
| 2020/0213787 | A1 | 7/2020 | Houcek et al. | |

FOREIGN PATENT DOCUMENTS

| | | | | |
|---|---|---|---|---|
| WO | WO-0169963 | A2 * | 9/2001 | H04R 11/02 |
| WO | WO-2013079930 | A2 * | 6/2013 | H04R 1/06 |
| WO | 2019/014510 | A2 | 1/2019 | |
| WO | WO-2019014510 | A2 * | 1/2019 | H04R 7/12 |

* cited by examiner

*Primary Examiner* — Ryan Robinson

(74) *Attorney, Agent, or Firm* — Faegre Drinker Biddle & Reath LLP

(57) ABSTRACT

An acoustic receiver includes a cover made from an electrically non-conductive material configured to cover an open end of a housing portion of the acoustic receiver. The cover has an inner surface and an outer surface. A motor is disposed on the inner surface, while electrical contacts are disposed on the outer surface. The motor is connected to the electrical contacts on the outer surface. Various electrical components, such as integrated circuits and sensors, are disposed on the outer surface. In one embodiment, the cover is a printed circuit board.

18 Claims, 3 Drawing Sheets

ACOUSTIC RECEIVER HOUSING WITH INTEGRATED ELECTRICAL COMPONENTS

TECHNICAL FIELD

The disclosure relates to acoustic receivers and, more specifically to acoustic receiver housings having integrated electrical components.

BACKGROUND

Acoustic receivers are used in hearing instruments such as hearing aids, headphones, and earbuds among other devices. Such receivers generally comprise a case or housing containing a diaphragm that separates an interior of the housing into front and back volumes. A motor located in the back volume typically includes an electrical coil disposed about an armature, also referred to as a reed, having a stationary end fixed to a yoke and a movable end disposed between magnets supported by the yoke. The movable portion of the armature is coupled to the diaphragm by a drive rod or other link. An electrical signal applied to the coil creates a magnetic field within the motor causing the reed to move between the magnets. Movement of the reed in turn causes movement of a diaphragm within the housing, from which sound is emitted from an acoustic port.

Receiver housings typically comprise two a multi-sided cup portions welded together after the motor and diaphragm are assembled in corresponding cup portions. The cups are typically formed from metal or other conductive material in a drawing operation. Electrical leads coupled winding of the electrical coil to electrical contacts on an interface fastened to an exterior of the housing.

Figure 1:
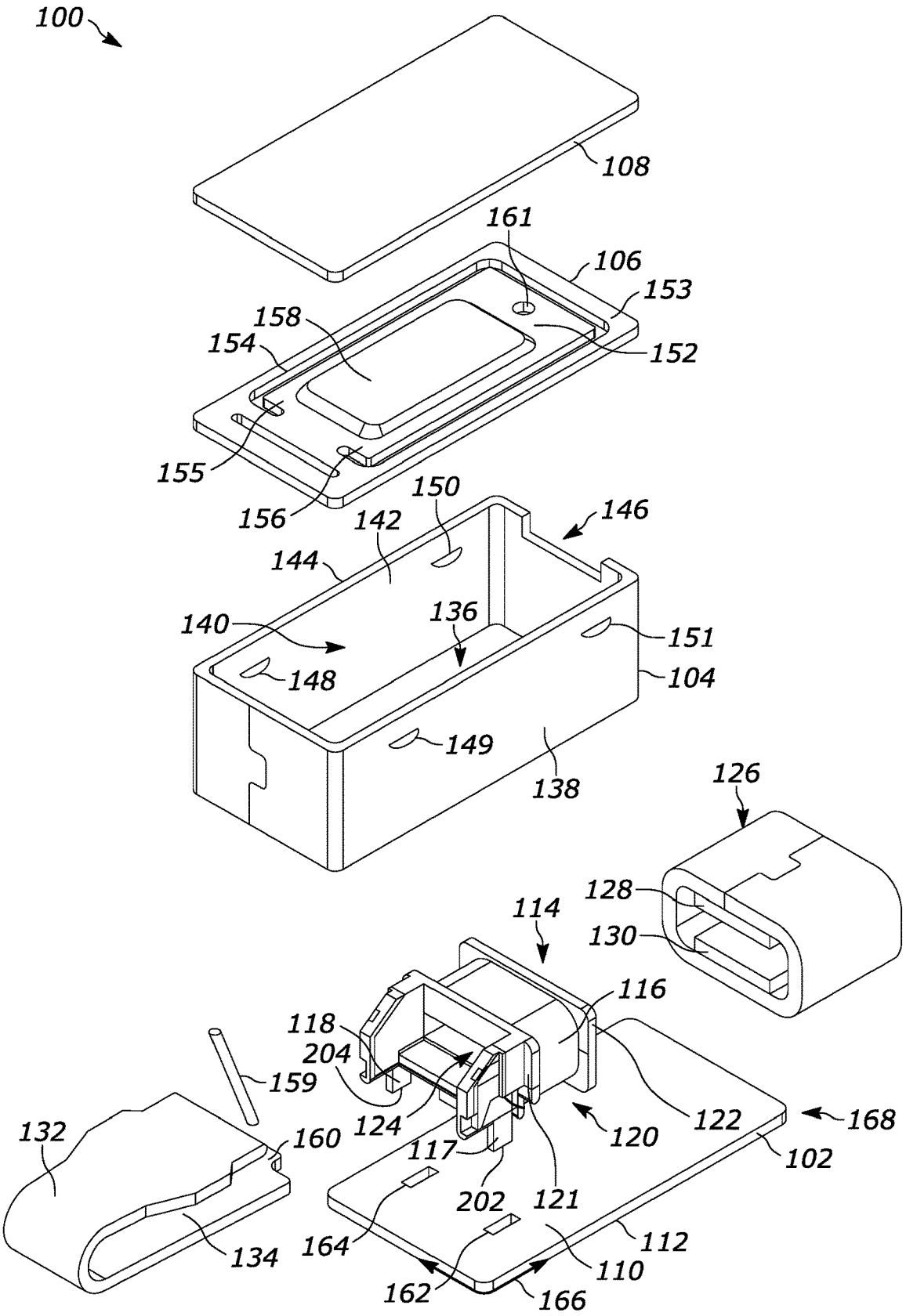
FIG. 1 is an exploded view of an acoustic receiver in accordance with one example.

Those of ordinary skill in the art will appreciate that elements in the figures are illustrated for simplicity and clarity. It will be further appreciated that certain actions or steps may be described or depicted in a particular order of occurrence while those of ordinary skill in the art will understand that such specificity with respect to sequence is not actually required unless a particular order is specifically indicated. It will also be understood that the terms and expressions used herein have the ordinary meaning as is accorded to such terms and expressions with respect to their corresponding respective fields of inquiry and study except where specific meanings have otherwise been set forth herein.

DETAILED DESCRIPTION

The disclosure is drawn generally to an acoustic receiver. A first cover for the acoustic receiver is made of an electrically non-conductive material having an inner surface and an outer surface. Electrical contacts are disposed on the outer surface of the first cover. A motor is disposed on the inner surface of the first cover. The motor includes a coil, a yoke that retains first and second magnets, and a reed that has a portion located adjacent to the coil and extending between the first and second magnets. The coil is connected to some of the electrical contacts on the first cover. A housing portion for the acoustic receiver includes a sidewall and a first open end. The first cover is fastened to the housing portion and covers the first open end. The housing portion and the first cover form a receiver housing in which the motor is disposed. A diaphragm is located in the receiver housing which separates an interior of the receiver housing into a front volume and a back volume. The motor is disposed in the back volume. A link interconnects a movable portion of the reed with a movable portion of the diaphragm. The reed is movable between the first and second magnets in response to an excitation signal applied to the coil.

In some examples, the motor includes electrical terminals integrated with a bobbin. In one embodiment, the electrical terminals are electrically coupled to the coil and to some of the electrical contacts on the first cover. In another embodiment, the electrical terminals extend through the first cover from the inner surface to the outer surface in a way that is substantially perpendicular to a plane of the first cover, where portions of the electrical terminals form some of the electrical contacts.

The sidewall defines the first open end of the housing portion. The sidewall also includes a second open end opposite the first open end. As such, the receiver housing includes a second cover fastened to the housing portion and covers the second open end. In some examples, various electrical components may be integrated on the covers. In one embodiment, an integrated circuit is disposed on and electrically coupled to the electrical contacts of the first or second cover. In another embodiment, a sensor is disposed on and electrically coupled to the electrical contacts of the first or second cover. The cover on which the integrated circuit or sensor is disposed is a printed circuit board.

According to another aspect, an acoustic receiver subassembly includes an electrically non-conductive material configured to cover an open end portion of a housing portion. A motor is fastened to an inner surface of the cover. The motor includes a bobbin about which an electrical coil is disposed. Electrical contacts are disposed on an outer surface of the cover with at least some of the electrical contacts being electrically coupled to the electrical coil.

In some examples, the motor includes electrical terminals integrated with the bobbin. In one embodiment, the electrical terminals are electrically coupled to the electrical coil and to some of the electrical contacts. In another embodiment, the electrical terminals extend through the cover in a way that is substantially perpendicular to a plane of the cover, where portions of the electrical terminals form some of the electrical contacts. The motor also includes a yoke retaining first and second magnets. A reed is located adjacent to the coil and extends between the first and second magnets.

The housing portion of the acoustic receiver subassembly includes sidewalls and the open end portion. The cover is fastened to the housing portion. The housing portion and the cover form a receiver housing containing the motor. In some examples, the cover is a printed circuit board and various electrical components may be integrated on the cover. In one embodiment, an integrated circuit is disposed on a surface of the cover and is electrically coupled to some of the electrical contacts. In another embodiment, a sensor is disposed on a surface of the cover and is electrically coupled to some of the electrical contacts.

According to one approach, an acoustic receiver subassembly is made by mounting a motor to an inner surface of an electrically non-conductive cover and electrically coupling an electrical coil to electrical contacts on an outer surface of the cover. The cover is configured to cover an open end of a housing portion. The motor includes a bobbin to support the electrical coil.

The step of electrically coupling the electrical coil to the electrical contacts further includes electrically coupling the electrical coil to electrical terminals integrated with the bobbin and extending the electrical terminals through the cover. Portions of the electrical terminals form the electrical contacts to which the electrical coil is electrically coupled.

The motor also includes a yoke that retains first and second magnets and a reed. As such, the step of mounting the motor to the inner surface of the cover further includes mounting the bobbin and the yoke to the cover so that the reed is adjacent to the electrical coil and extends between the magnets. In making the acoustic receiver subassembly, an integrated circuit or a sensor can be fastened to the cover and electrically coupled to some of the electrical contacts via electrical traces of the cover.

FIG. 1 illustrates one example of an acoustic receiver 100 that includes a first cover 102, a housing portion 104, a diaphragm 106, and a second cover 108. The acoustic receiver may be a single armature receiver, a multiple armature receiver, or any other suitable acoustic receiver. The first cover 102 is comprised of an electrically non-conductive material (e.g., FR-4, epoxy, plastic, ceramic, glass fiber, etc.). The second cover 108 may be comprised of a conductive or non-conductive material.

The first cover 102 has an inner surface 110 and an outer surface 112. A motor 114 is disposed on the inner surface 110 of the first cover 102. The motor 114 includes an electrical coil 116 and electrical terminals 117, 118. The coil 116 is wound around a bobbin 120 with a first flanged section 121 and a second flanged section 122. The electrical terminals 117, 118 are integrated with the bobbin 120. The coil 116 is electrically coupled to the electrical terminals 117, 118 using conventional techniques known in the art. The bobbin 120 is mounted on the first cover 102 and in some embodiments fastened thereto by adhesive. The coil 116 includes a coil passage 124 and a yoke 126 that retains a first magnet 128 and a second magnet 130 in spaced apart relation. A reed (or armature) 132 has a portion 134 located adjacent the coil 116 and extends between the magnets 128 and 130.

In this example, the yoke 126 is a stamped and folded structure with butt-joined ends. In other examples, the yoke may be stacked closed-ended plates welded together, or a section of extruded tube stock, or any other suitable structure. The first and second magnets 128, 130 may be fastened to the yoke 126 by a weld, adhesive, crimped flanges, or some other fastening mechanism. The yoke 126 may be fastened to the first cover 102 by adhesive or other suitable fastening mechanism. The reed 132 is a U-reed having a fixed end portion fastened to the yoke 126. In other embodiments, the reed has a different configuration, for example, an E-reed.

The housing portion 104 is disposed about the motor 114. The housing portion 104 includes a first open end 136, a sidewall 138, and a second open end 140. The sidewall 138 may include one or more sidewall portions. The housing portion 104 also includes an inside surface 142 and an outside surface 144. The sidewall 138 defines the first open end 136 and the second open end 140. In some embodiments, the housing portion 104 is formed from a strip of folded material with butt-joined ends, where the sidewall 138 is partly defined by folds in the strip of material. In other embodiments, the housing portion 104 may be embodied as a five-sided cup with only a single open end or as a section of an extruded tube.

The housing portion 104 includes an acoustical port 146 and a diaphragm-support structure, such as diaphragm-support projections 148-151 that are adapted to support the diaphragm 106. However, any suitable support structure may be employed. In FIG. 1, the diaphragm-support projections 148-151 are made by stamping the outside surface 144 such that the projections protrude on the inside surface 142. On the outside surface 144, these projections appear as recesses or indentations. While FIG. 1 shows four diaphragm-support projections, any number, shape and configuration of diaphragm-support projections located in any suitable location of the housing portion may be used in other embodiments.

The first and second covers 102, 108 are fastened to the housing portion 104 and cover the first and second open ends 136, 140, respectively. For example, the covers 102, 108 can be fastened to the housing portion 104 by a weld, adhesive, crimped flanges, or some other fastening mechanism. In embodiments where the housing is a five-sided cup, only the first cover 102 is fastened thereto. The housing portion 104 and the first cover 102 form a receiver housing for the motor.

The diaphragm 106 is also located in the receiver housing and supported by the diaphragm-support projections 148-151. The diaphragm 106 separates an interior of the receiver housing into a front volume and a back volume. The motor 114 is disposed in the back volume.

The diaphragm 106 includes a paddle 152, a frame 153, and a gap 154 separating the paddle and the frame. The diaphragm 106 further includes hinge members 155, 156 connecting the paddle to the frame. There is also a relief 158 on the paddle 152 that stiffens the paddle to reduce resonance. In FIG. 1, the gap is generally U-shaped, and the hinge members are torsional hinge members that form torsion hinges disposed on opposite sides of the paddle. In other embodiments, the hinge members may be cantilever hinge members that form cantilever hinges disposed along a single side of the paddle. The gap may be covered by a urethane film (not shown) to form an air seal. When moved, the paddle 152 causes sound to emanate from the acoustical port 146. The diaphragm 106 may be made of a variety of materials (e.g., aluminum, nickel, copper, etc.) and fabricated from a single, unassembled member or formed as an assembly of separate parts.

A link embodied as a drive rod 159, interconnects a moveable portion 160 of the reed with the paddle. The link is attached to the reed 132 and passed and to the paddle at an opening 161 thereof. The reed 132 is moveable between the first and second magnets 128, 130 in response to an excitation signal applied to the coil 116.

Various electrical contacts (see, e.g., coil contacts 202, 204 in FIG. 2) are disposed on the outer surface 112 of the first cover 102. The coil 116, via the electrical terminals 117, 118, is connected to the coil contacts. In one embodiment, the electrical terminals 117, 118 extend through the first cover 102 from the inner surface 110 to the outer surface 112 via contact openings 162, 164 in the first cover 102. The contact openings 162, 164 extend through the thickness of the first cover 102 and allow the electrical terminals 117, 118 to pass through the first cover 102 in a way that is substantially perpendicular to a plane 166 of the first cover 102. In this manner, portions of the electrical terminals 117, 118 form the coil contacts.

In another embodiment, contacts on the inner surface 110, such as the electrical terminals 117, 118, are electrically coupled to the coil contacts on the outer surface 112 through conductive vias or electrical traces on the first cover 102. It should be recognized that other structures and combinations can be employed to connect the coil 116 to the contacts 202, 204 on the outer surface 112 (e.g., one electrical terminal 117 can extend through the first cover 102 to form one of the coil contacts 202, 204, while another electrical terminal 118 can be electrically coupled to the other one of the bobbin contacts 202, 204 via electrical traces on the first cover 102). In various embodiments, the first cover 102, the motor 114, and various electrical contacts such as the coil contacts 202, 204 form an acoustic receiver subassembly 168.

Figure 2:
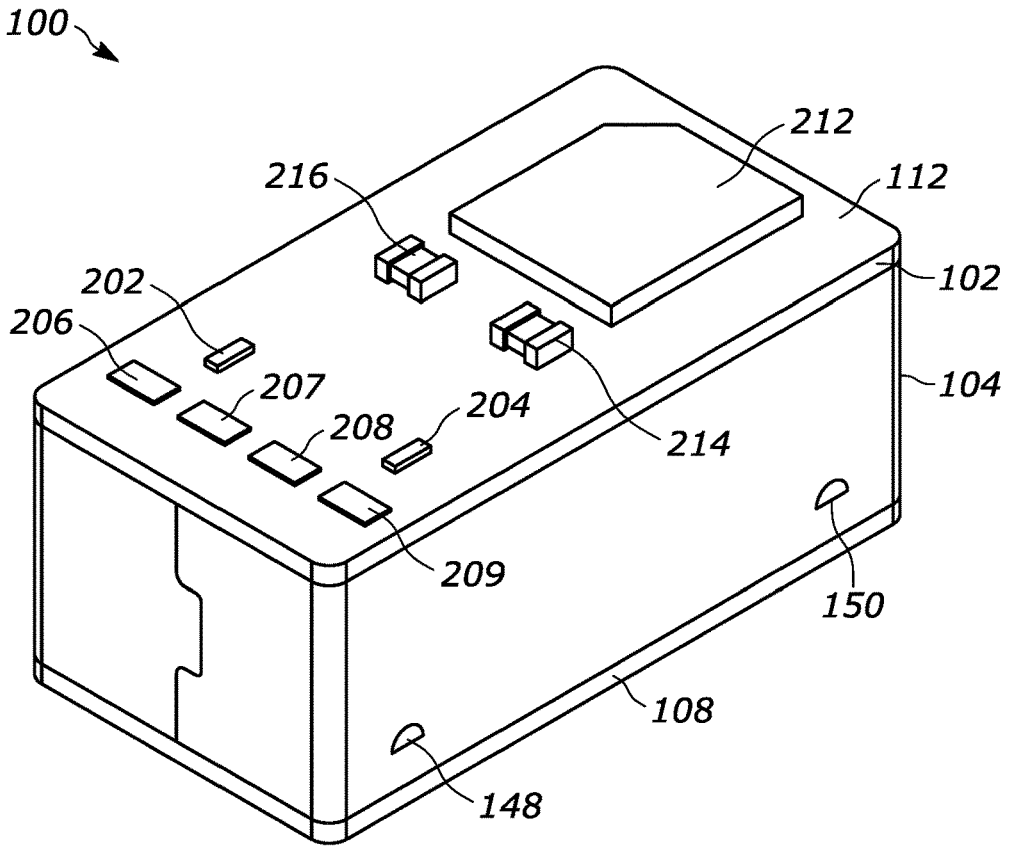
FIG. 2 is a perspective view of an assembled acoustic receiver in accordance with one example.
Figure 3:
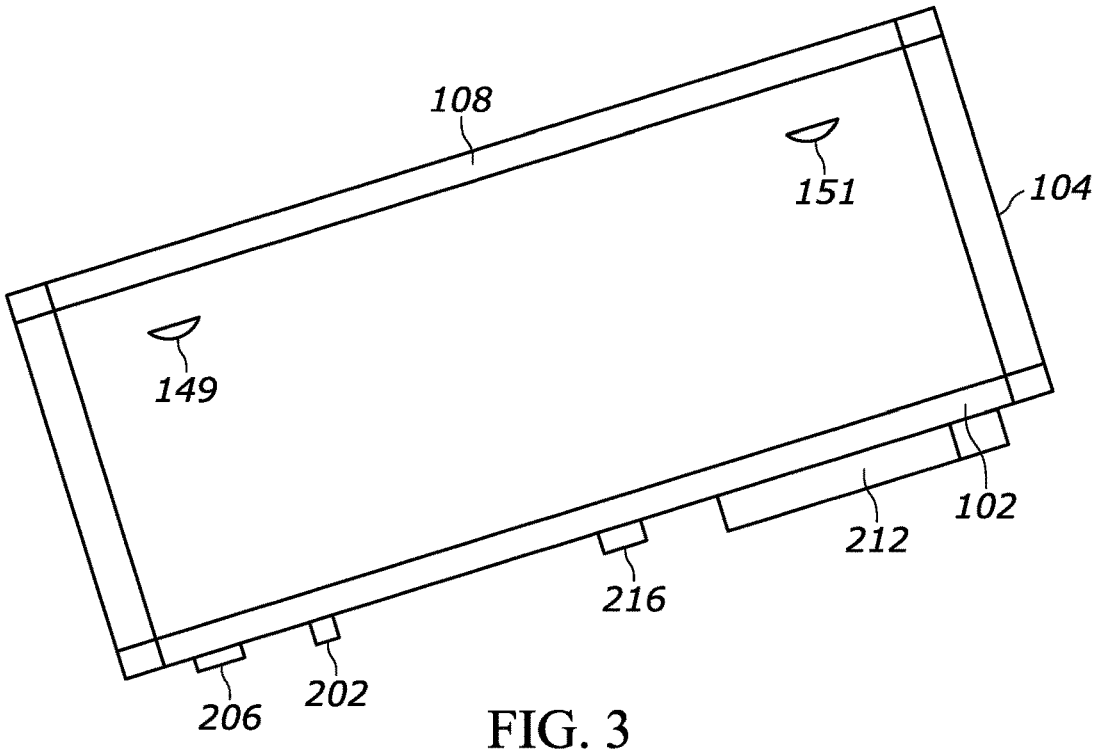
FIG. 3 is a side view of the acoustic receiver of FIG. 2.

FIGS. 2 and 3 illustrate the acoustic receiver 100 after being assembled with the first cover 102, the housing 104, and the second cover 108. In this example, the first cover 102 is comprised of a printed circuit board (PCB) or other non-conductive material. FIG. 2 shows the outer surface 112 of the first cover 102 with various electrical contacts including the coil contacts 202, 204 and a ground pad (GND) 206, a power pad (VDD) 207, and in some embodiments signaling pads (e.g., SLC, SDA) 208, 209. The various electrical contacts also include suitable contacts (not shown) for mounting an electrical component 212 and other devices 214, 216 (e.g., integrated circuits, sensors, surface-mounted resistors, capacitors, etc.) to the cover 102.

In FIG. 2, the electrical component 212 is disposed on the first cover 102 (e.g., surface mounted). In one embodiment, the electrical component 212 is an integrated circuit (IC) surface mounted on the cover 102 and electrically connected to contacts thereon. The IC may be electrically coupled to some of the electrical contacts 206-209 (e.g., power, ground, data, etc.) via electrical traces form on or in the first cover 102. The IC can be an application-specific integrated circuit (ASIC) chip configured to process information associated with the operation or performance of the acoustic receiver (e.g., self-diagnostics, self-monitoring, etc.). In this manner, testing of the acoustic receiver 100 may be performed on-device rather than off-device. In another embodiment, the IC is an audio processor. Other ICs and combinations may be used in other embodiments. In one example, the coil 116 is coupled to the coil contacts via the IC.

In another embodiment, a sensor forms the electrical component 212 mounted on the cover 102. The sensor may be electrically coupled to some of the electrical contacts 206-209 via electrical traces on or in the first cover. The sensor can be used to detect physiological conditions. For example, the sensor may an infrared or ultrasonic sensor used to detect one or more of blood pressure, heart rate, and body temperature. The sensor can also be used to detect environmental conditions. For example, the sensor may be a microphone used to detect ambient sound or an accelerometer used to detect shock. Other suitable types of sensors are contemplated in other embodiments.

In various embodiments, the electrical component 212 may include one or more ICs and one or more sensors. In this scenario, the one or more ICs can be configured to receive and process information (e.g., analog signal, digital signal, etc.) from the one or more sensors. While FIG. 2 shows the electrical component 212 as being disposed on the outer surface 112 of the first cover 102, in other embodiments, the electrical component 212 can be disposed on either the inner or outer surfaces 110, 112 of either the first or second covers 102, 108. Further, the first and second covers 102, 108 may be comprised of other suitable materials besides PCB.

Unlike prior designs, by having the first and/or second covers 102, 108 made from an electrically non-conductive material, the surfaces of the covers can be integrated with additional electrical components to provide added functionalities for the acoustic receiver 100. Moreover, by having the electrical terminals 117, 118 extend through the cover, the overall size of the acoustic receiver 100 can be reduced in at least one dimension resulting in a smaller form factor.

Figure 4:
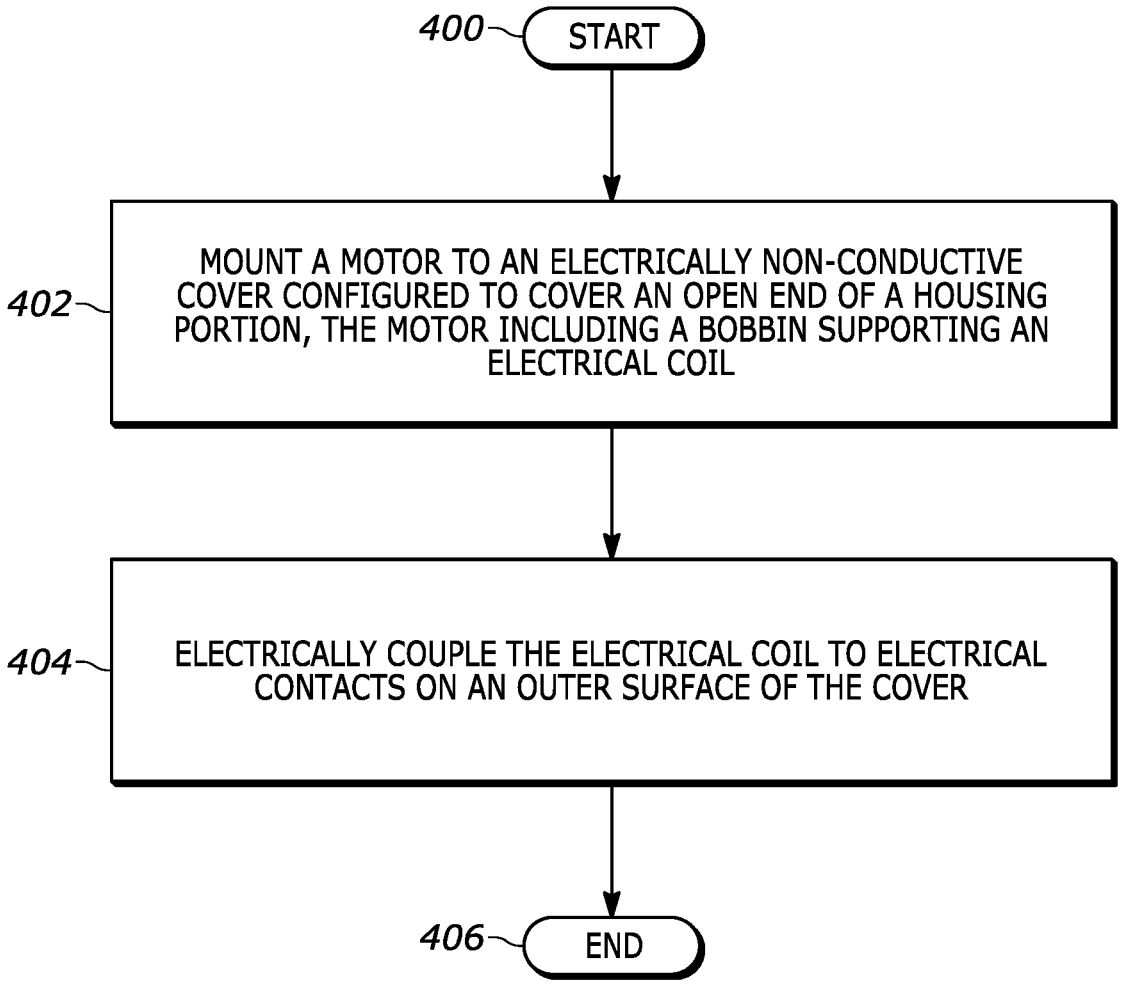
FIG. 4 is a flowchart of a method for manufacturing an acoustic receiver in accordance with one example.

FIG. 4 illustrates a method for making an acoustic receiver subassembly, such as the acoustic receiver subassembly 168 in FIG. 1. The operations described herein may be performed using manual or automated assembly machines and fixtures. As shown in FIG. 4, construction of the acoustic receiver subassembly is shown starting in block 400. In block 402, a motor including a bobbin supporting an electrical coil is mounted on an inner surface of an electrically non-conductive cover. The cover is configured to cover an open end of a housing portion of the acoustic receiver subassembly. The motor also includes a yoke that retains first and second magnets and a reed. As such, mounting the motor on the inner surface of the cover includes mounting the bobbin and the yoke to the cover so that the reed is adjacent to the electrical coil and extends between the first and second magnets.

In block 404, electrical contacts on an outer surface of the cover are electrically coupled to the electrical coil. In particular, electrical terminals integrated with the bobbin are electrically coupled to the electrical coil using conventional techniques known in the art. The electrical terminals are then connected to the electrical contacts on the outer surface. In one embodiment, the electrical terminals are configured to extend through the cover, where portions of the electrical terminals form the electrical contacts to which the electrical coil is electrically coupled. In another embodiment, the electrical terminals are electrically coupled to the electrical contacts on the outer surface through conductive vias or electrical traces on the cover. In block 406, the construction of the acoustic receiver subassembly is complete. However, in various embodiments, electrical components, such as an IC and/or a sensor, can be fastened to the cover and electrically coupled to at least some of the electrical contacts via electrical traces of the cover.

Among other advantages, employing an electrically non-conductive or non-metal cover for an acoustic receiver housing enables additional electrical components to be integrated with the cover to provide added functionalities for an acoustic receiver, such as on-device data processing. Further, employing the non-metal cover also enables the electrical terminals of the acoustic receiver to form extensions through the cover as opposed to protruding out from a sidewall of the acoustic receiver housing. This can reduce the overall length of the acoustic receiver housing resulting in a smaller form factor. This can also facilitate better self-alignment during the assembly of the acoustic receiver resulting in a faster and more cost-effective assembly process.

While the present disclosure and what is presently considered to be the best mode thereof has been described in a manner that establishes possession by the inventors and that enables those of ordinary skill in the art to make and use the same, it will be understood and appreciated that there are many equivalents to the exemplary embodiments disclosed herein and that myriad modifications and variations may be made thereto without departing from the scope and spirit of the disclosure, which is to be limited not by the exemplary embodiments but by the appended claims.

The invention claimed is:

1. An acoustic receiver comprising:

a first cover comprised of an electrically non-conductive material having an inner surface and an outer surface, wherein the first cover is a printed circuit board (PCB) that includes an integrated circuit or a sensor disposed on the first cover;

a motor disposed on the inner surface of the first cover, the motor including a coil, a yoke retaining first and second magnets, and a reed having a portion located adjacent to the coil and extending between the first and second magnets, the coil being connected to electrical contacts disposed on the outer surface of the first cover;

a housing portion including a sidewall and a first open end, the first cover fastened to the housing portion and covering the first open end, wherein the housing portion and the first cover form a receiver housing in which the motor is disposed;

a diaphragm located in the receiver housing, the diaphragm separating an interior of the receiver housing into a front volume and a back volume, wherein the motor is disposed in the back volume; and a link interconnecting a movable portion of the reed with a movable portion of the diaphragm, wherein the reed is movable between the first and second magnets in response to an excitation signal applied to the coil.

2. The receiver of claim 1, wherein the motor comprises electrical terminals integrated with a bobbin, the electrical terminals electrically coupled to the coil and to at least some of the electrical contacts.

3. The receiver of claim 1, wherein the motor comprises electrical terminals integrated with a bobbin, the electrical terminals extending through the first cover, from the inner surface to the outer surface substantially perpendicular to a plane of the first cover, wherein portions of the electrical terminals form at least some of the electrical contacts.

4. The receiver of claim 1, wherein the sidewall defines the first open end of the housing portion.

5. The receiver of claim 4, wherein the sidewall includes a second open end opposite the first open end, the receiver housing including a second cover fastened to the housing portion and covering the second open end.

6. The receiver of claim 1, wherein the first cover includes the integrated circuit that is electrically coupled to the electrical contacts of the first cover.

7. The receiver of claim 1, wherein the first cover includes the sensor that is electrically coupled to the electrical contacts of the first cover.

8. An acoustic receiver subassembly comprising:

a cover comprised of an electrically non-conductive material, the cover fastened to sidewalls of a housing portion and covering an open end portion of the housing portion, wherein the cover is a printed circuit board (PCB) that includes an integrated circuit or a sensor disposed on the cover;

a motor fastened to an inner surface of the cover, the motor comprising a bobbin about which an electrical coil is disposed; and electrical contacts on an outer surface of the cover, at least some of the electrical contacts electrically coupled to the electrical coil, wherein the housing portion and the cove-form a receiver housing containing the motor.

9. The subassembly of claim 8, wherein the motor comprises electrical terminals integrated with the bobbin, the electrical terminals electrically coupled to the electrical coil and to at least some of the electrical contacts.

10. The subassembly of claim 8, wherein the motor comprises electrical terminals integrated with the bobbin, the electrical terminals extending through the cover, substantially perpendicular to a plane of the cover, wherein portions of the electrical terminals form at least some of the electrical contacts.

11. The subassembly of claim 9, wherein the motor includes a yoke retaining first and second magnets, and a reed located adjacent to the coil and extending between the first and second magnets.

12. The subassembly of claim 8, wherein the cover includes the integrated circuit that is electrically coupled to at least some of the electrical contacts.

13. The subassembly of claim 8, wherein the cover includes the sensor that is electrically coupled to at least some of the electrical contacts.

14. A method of making an acoustic receiver subassembly, the method comprising:

mounting a motor to an inner surface of an electrically non-conductive cover, the cover fastened to sidewalls of a housing portion and covering an open end of the housing portion, the motor including a bobbin supporting an electrical coil; and electrically coupling the electrical coil to electrical contacts on an outer surface of the cover, wherein the cover is a printed circuit board (PCB) that includes an integrated circuit or a sensor disposed on the cover, and wherein the housing portion and the cover form a receiver housing containing the motor.

15. The method of claim 14, wherein electrically coupling the electrical coil to the electrical contacts includes electrically coupling the electrical coil to electrical terminals integrated with the bobbin and extending the electrical terminals through the cover, wherein portions of the electrical terminals form the electrical contacts to which the electrical coil is electrically coupled.

16. The method of claim 14, wherein the motor includes a yoke retaining first and second magnets and a reed, and mounting the motor on the inner surface of the cover includes mounting the bobbin and the yoke to the cover so that the reed is adjacent to the electrical coil and extends between the first and second magnets.

17. The method of claim 14, wherein the cover includes the integrated circuit and the method further comprises fastening the integrated circuit to the cover by electrically coupling the integrated circuit to at least some of the electrical contacts via electrical traces of the cover.

18. The method of claim 14, wherein the cover includes the sensor and the method further comprises fastening the sensor to the cover by electrically coupling the sensor to at least some of the electrical contacts via electrical traces of the cover.

* * * * *